US007500588B2

(12) United States Patent
McGuinness et al.

(10) Patent No.: US 7,500,588 B2
(45) Date of Patent: Mar. 10, 2009

(54) TIN TAG DISPENSING AND NAILING TOOL

(76) Inventors: Thomas J. McGuinness, 19002 SE. Hillcrest Dr., Jupiter, FL (US) 33469; James M. McGuinness, 1076 NE. Banyan Tree Dr., Jensen Beach, FL (US) 34957; Thomas L. McCart, 3221 Peak Rd., Conyers, GA (US) 30013

( * ) Notice: Subject to any disclaimer, the term of this patent is extended or adjusted under 35 U.S.C. 154(b) by 26 days.

(21) Appl. No.: 11/888,863

(22) Filed: Aug. 2, 2007

(65) Prior Publication Data

US 2009/0032565 A1 Feb. 5, 2009

(51) Int. Cl.
*B25C 7/00* (2006.01)

(52) U.S. Cl. ..... 227/18; 227/119; 227/138; 206/445; 221/197

(58) Field of Classification Search ..... 227/15, 227/18, 119, 120, 135, 138, 99, 100, 136; 206/445, 303; 221/197, 198, 289
See application file for complete search history.

(56) References Cited

U.S. PATENT DOCUMENTS 4,246,939 A * 1/1981 Boegel ..... 29/771
4,890,968 A * 1/1990 Beach et al. ..... 411/531
5,056,684 A * 10/1991 Beach et al. ..... 221/197
5,067,865 A * 11/1991 Zylka et al. ..... 411/531
5,184,752 A * 2/1993 Zylka et al. ..... 221/1
5,634,583 A 6/1997 McGuinness
5,791,546 A 8/1998 McGuinness
6,273,315 B1 8/2001 McGuinness
6,273,316 B1 * 8/2001 Losada ..... 227/119
6,481,611 B2 * 11/2002 Losada ..... 227/119
6,824,036 B2 * 11/2004 Walter ..... 227/120
6,837,412 B2 * 1/2005 Lamb ..... 227/18
6,908,022 B2 * 6/2005 Schmitz ..... 227/119
6,932,260 B1 * 8/2005 Chou ..... 227/18
7,111,767 B2 * 9/2006 Losada ..... 227/119

* cited by examiner

*Primary Examiner*—Scott A. Smith
(74) *Attorney, Agent, or Firm*—Lawrence E Laubscher, Sr.; Lawrence E Laubscher, Jr.

(57) ABSTRACT

An improved tin tag dispensing and nailing tool includes an operating member that is adapted for connection with a roofer's nailing gun, which operating member is guided by a pair of spaced vertical guide rods for vertical sliding displacement relative to the tool housing between an upper retracted position and a lower nailing position. The operating member is formed from a synthetic plastic material and contains vertical though bores that respectively receive the guide rods. Tubular oil-impregnated bushings are mounted in the through bores concentrically about the guide rods. A linkage arrangement connects the operating member with a shuttle plate that is displaced between a loading position adjacent the tin tag supply station and a discharging position adjacent the tin tag nailing station. An integral punched-out tongue portion extends upwardly at an acute angle from the shuttle plate for engagement with the lowermost tin tag of a stack.

9 Claims, 4 Drawing Sheets

160a
116
160e
160c
160f
117
160

128
128a
112
113
116
160e
160f
117
160a
162
160

128a
112
160e
160f
116
160a
117
160
162

116
160g
160c
11
160b
160g
116
117
160e
161
60a
60
163
60a 104a
160a
160
117
128
116
160b
131
132
162
130
160e
160c
162
116
117
160a

TIN TAG DISPENSING AND NAILING TOOL

BACKGROUND OF THE INVENTION

1. Field of the Invention

An improved tin tag dispensing and nailing tool includes an operating member that is adapted for connection with a roofer's nailing gun, which operating member is guided by a pair of spaced vertical guide rods for vertical sliding displacement relative to the tool housing between an upper retracted position and a lower nailing position. The operating member is formed from a synthetic plastic material and contains vertical though bores that respectively receive the guide rods. Tubular oil-impregnated metal bushings are mounted in the through bores concentrically about the guide rods. A linkage arrangement connects the operating member with a shuttle plate that is displaced between a loading position adjacent the tin tag supply station and a discharging position adjacent the tin tag nailing station. An integral punched-out tongue portion extends upwardly at an acute angle from the shuttle plate for engagement with the lowermost tin tag of a vertical tin tag stack.

2. Description of Related Art

As evidenced by the prior U.S. patents to Thomas J. McGuinness et al U.S. Pat. Nos. 5,634,583, 5,791,546 and 6,273,315, attachments for roofer's nailing guns have been proposed for automatically feeding successive metal tin tag disks to the gun, so that when the operator places the gun next to the work and triggers the gun to drive a nail through a tin tag and into the work, upon withdrawal of the gun from the work, a subsequent tin tag is automatically displaced from the bottom of a supply stack and positioned in the nailing support means for the next nailing operation.

During the operation of such tin tag dispensing means, it has been found that the guide mean for guiding the operating components of the tool become worn as a result of extensive use, adversely affecting the operability and life of the tool. Furthermore, it has been proven through use that the shuttle means for displacing the lowermost tin tag from the stack becomes worn and ineffective during use, thereby resulting in jamming of the tool.

The present invention was developed to avoid the above and other drawbacks of the known tin tag supply devices for use with roofer's guns

SUMMARY OF THE INVENTION

Accordingly, a primary object of the present invention is to provide a tin tag supply device having improved guide means for guiding the gun-attached operating member during the displacement thereof relative to the tin tag housing as the nailing gun is displaced toward and away from the work during repeated nailing operation.

A more specific object of the invention is to provide guide means including a pair of parallel vertical guide rods that extend through corresponding through bores contained in an operating member that is formed from a hard synthetic plastic material. One end of the operating member is provided with a first projection that is adapted for connection with the nailing gun. The other end of the operating member is provided with a pair of horizontally spaced second projections that are provided with cam pins that extend laterally outwardly from the second projections into cam slots contained in the levers that operate the reciprocatory shuttle means to displace a tin tag from the bottom of a stack and to transport the removed tin tag toward the nailing station. The upper ends of the levers are pivotally connected with the upper cap portion of the body portion of the attachment tool, and the lower ends of the guide rods are fastened to the horizontal base portion of the tool body. Preferably, oil-impregnated tubular bearings of bronze or brass are mounted within the through bores of the operating member concentrically about the guide rods, thereby to lubricate the rods to improve the sliding movement of the operating member.

A further object of the invention is to provide a shuttle plate that is formed from resilient tempered steel and includes an integral upwardly-bent tongue that extends between a pair of support rails, thereby to engage the lowermost tin tag from the stack seated on the support rails, and to displace the tag toward the nailing station.

Preferably, the operating member is formed from a hard synthetic plastic material, such as 6619 nylon, a 66% nylon/33% glass composition. The improved guide means eliminates side-to-side sway, produces little wear factor of the synthetic plastic material, and results in two dissimilar materials riding as a bearing surface. The original prior art guide means generated significant friction, with subsequent premature wear of the molded plastic components, thereby reducing the life of the tool. Because of the excess friction, the application of additional lubricating oil was required at regular intervals to hold the excessive wear of the molded plastic components to an absolute minimum.

The new improved vertical motion of the metal cam is designed and created through a redesigned plastic sliding mount with inserted bronze bushings, which are permanently oil-saturated for lubrication at manufacture. The two independent parallel bushings slide on polished chrome shafts attached and fixed to the base and cap housing components, thereby resulting in significantly reduced contact friction and wear through permanent lubrication from the oil-saturated bearings.

The stainless steel piston of the prior art is replaced by a shuttle plate member that is formed from resilient tempered steel that retains the memory characteristics necessary and provides jam-free operation. The spring steel shuttle plate allows for flexing under the tin tags when shuttling to the loading position, and when the tin tag is shuttled to the firing position, the punched out tongue springs upward to position a tin tag and provides vertical movement. The prior art piston design carried the entire stainless hardware plate along with the tin tag itself to the firing position for every shot. The new design pushes the tin tag to the firing position which results in moving much less hardware, produces reduction in weight, and allows for a much more efficient operation.

The body portion of the tool housing includes a top cap section that is arranged above a horizontal support plate that includes a marginal portion containing openings that receive the upper ends of the stainless steel guide rods. The operating member is spring biased upwardly into engagement with the horizontal support plate when the operating member is in its initial retracted position. Owing to the improved shuttle plate design, the recess of the plates avoid the roofing tar buildup on the tool that is always a problem during extend use in hot weather. With the plastic now riding and contacting the roofing paper instead of the metal plates, the problem of buildup is significantly reduced if not eliminated. in damp or extremely hot weather conditions, the roofing paper becomes very sticky and can create a severe problem with build-up. The roofing paper tar does not adhere to the redesigned synthetic plastic base.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 2:
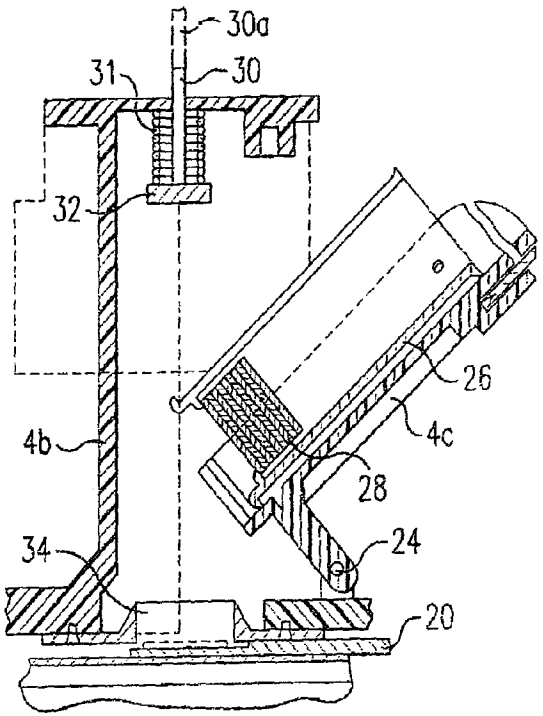
FIG. 2 PRIOR ART
FIG. 2 is a sectional view of a prior art tin tag attachment illustrating the cartridge receiving means in the open condition.
Figure 3:
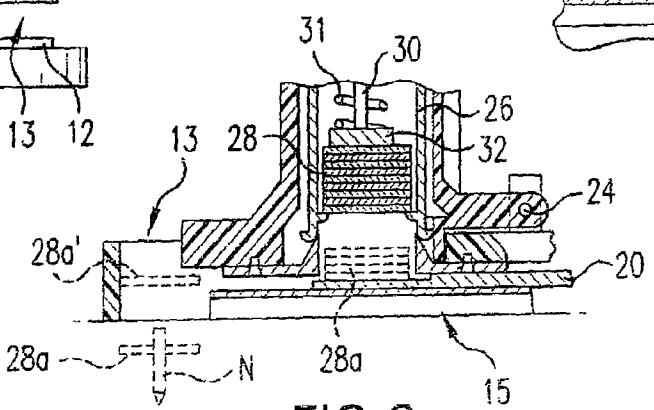
FIG. 3 is a detailed view of the apparatus of FIG. 2 with the cartridge receiving means in the closed condition.
Figure 1:
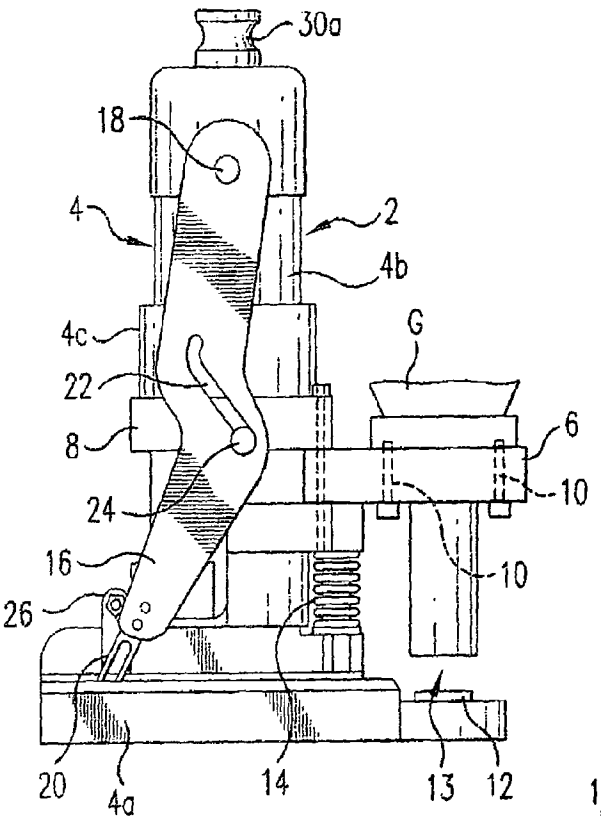
FIG. 1 PRIOR ART
FIG. 1 is a side elevation view of a prior art tin tag supply attachment for a roofer's nailing gun.

Referring first more particularly to FIGS. 1-3, it is known in the prior art to provide an attachment means 2 for supplying tin tags to a nailing gun G. The attachment means includes a housing 4 having a horizontal base portion 4*a*, and a generally cylindrical hollow upwardly extending vertical body portion 4*b*. An operating member 6 is connected by a circular sleeve 8 for vertical sliding movement relative to the body portion 4*b*. A conventional nailing gun G is fastened to the operating member 6 by screw thread fastener means (not shown) extending through fastening holes 10. The nailing gun G is directed downwardly toward tin tag support means 12 arranged at a nailing station 13 on the housing base portion 4*a*. Compression spring means 14 bias the operating member 6 upwardly toward a retracted position relative to the housing base portion 4*a*. Linkage means are provided for operating shuttle means to displace tin tags from a stack contained within the housing body portion 4*b* from a supply station toward the nailing station 13. These linkage means include a pair of levers 16 arranged on opposite sides of the housing body portion and pivotally connected at their upper ends with the body portion 4*b* by the pivot pins 18. The lower ends of the lever 16 are connected with shuttle means 20 that are operable to displace the lowermost tin tag from the stack 28 contained within the body portion 4*b* toward the nailing station 12. More particularly, the levers 16 contain intermediate their ends cam slots 22 that receive cam pins 24 that extend outwardly from opposite sides of the guide sleeve 8. Therefore, when the nailing gun G is displaced downwardly toward the illustrated nailing position to compress the spring 14, the levers 16 are pivoted in the clockwise direction so that the shuttle 20 is in its loading position. Following operation of the nailing gun G, the operating member 6 is displaced upwardly by the spring 14 to cause levers 16 to pivot in the counter-clockwise direction so that the shuttle means 20 will displace the lower most tin tag from the stack toward the nailing station 12.

As shown in FIG. 2, the housing body portion 4*b* is hollow and includes a cartridge supporting section 4*c* that is pivotally displaceable about the pivot axis 24 from the open position of FIG. 2 toward the closed position of FIG. 1. The housing support section 4*c* supports the cartridge 26 that contains the stack 28 of tin tags. When the cartridge support section 4*c* is pivoted toward the closed position of FIG. 3, the biasing rod 30 having an operating extremity 30*a* is biased downwardly by the compression spring 31, thereby to cause the pressure plate 32 to engage the top of the tin tag stack 28 as shown in FIG. 3. Therefore, when the shuttle 20 is displaced from the loading position of FIG. 3 toward the tin tag support means 12 at the nailing station 13, the nailing gun may be operated to drive a nail N through the tin tag disk and thereby displace the same from the tool toward the position shown in phantom at 28*a*".

Figure 5:
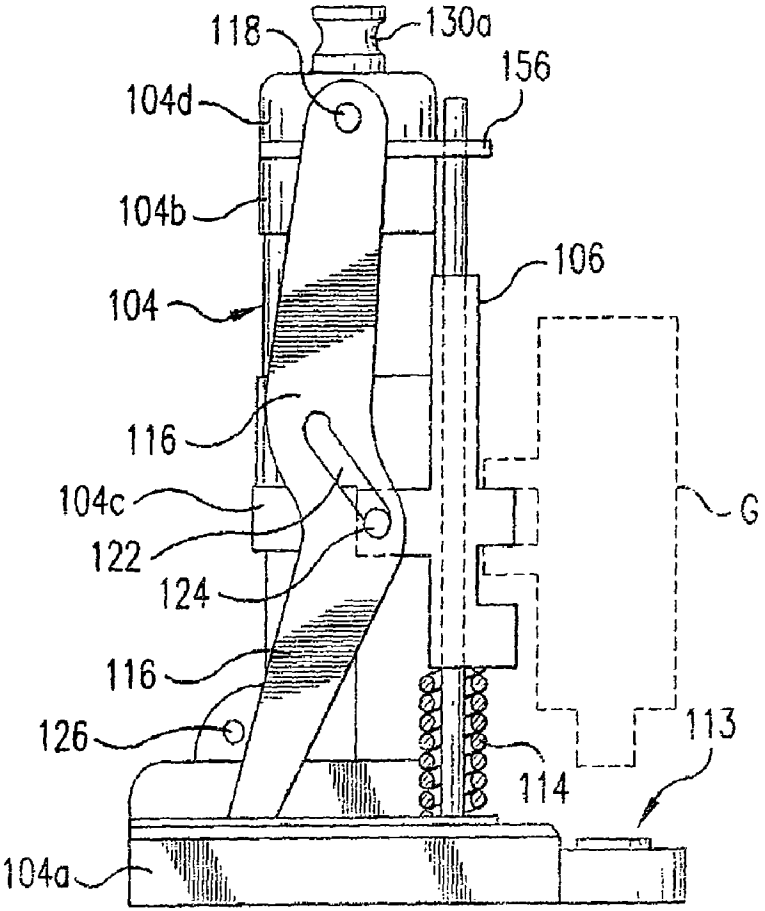
FIG. 5 is a corresponding view with the operating member in its lower nailing position.
Figure 4:
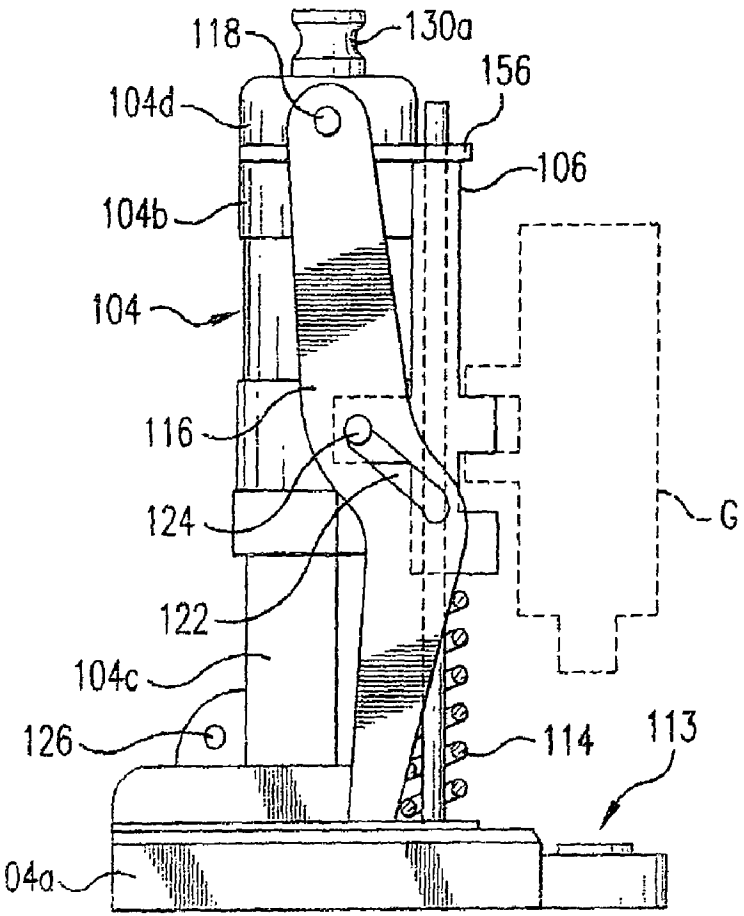
FIG. 4 is a side elevation view of the tin tag supply attachment of the present invention when the operating member is in its normal retracted upper position relative to the housing.
Figure 6:
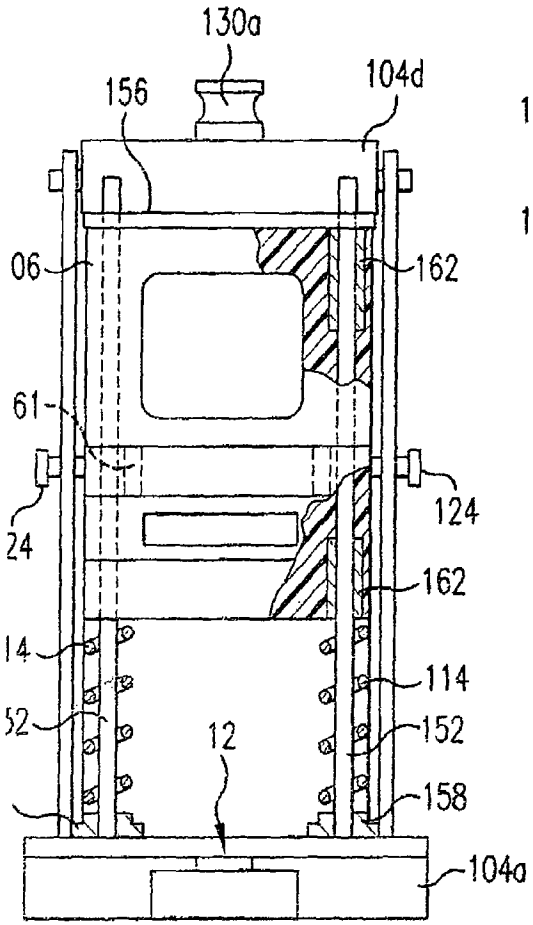
FIG. 6 is a front view of the attachment means of FIG. 4.

Referring now to FIGS. 4 and 5, in accordance with the present invention, an improved guide system is provided for guiding the operating member 106 between its upper retracted position of FIG. 4 and its lower nailing position adjacent the nailing station 113 as shown in FIG. 5. More particularly, as shown in FIG. 6, the operating member 106 comprises a generally rectangular block that is formed of a hard synthetic plastic material in which contains a pair of through bores 150 that receive a pair of vertical guide rods 152, preferably formed of chrome. At their upper ends, the guide rods 152 are supported by a support plate 156 that contains openings for receiving the upper ends of the guide rods 152. As best shown in FIGS. 4 and 5, the support plate 156 is arranged between the housing cap section 104*d* and the main housing body portion 104*b*. As shown in FIG. 6, the lower ends of the vertical guide rods 152 are fastened to the housing base portion 104*a* by means of the rod fastening means 158. Compression springs 114 arranged concentrically about the guide rods between the base portion 104*a* and the operating member 106 bias the operating member 106 upwardly toward the initial retracted position in engagement with the support plate 156, as shown in FIGS. 4 and 6.

Figure 8:
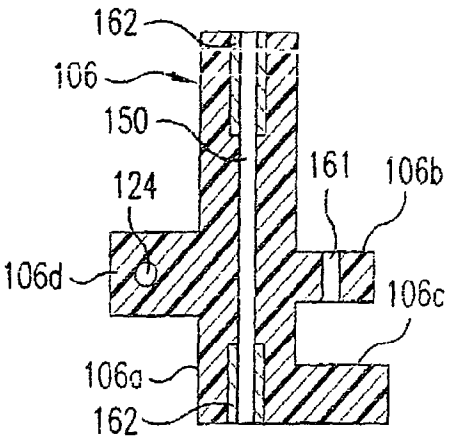
FIG. 8 is a sectional view taken along line 8-8 of FIG. 7.
Figure 9:
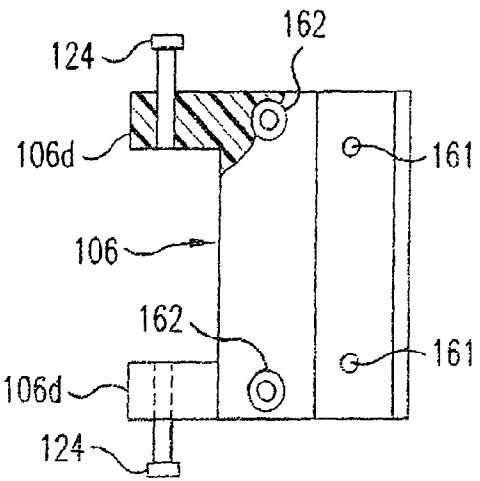
FIG. 9 is a top plan view of the operating member of FIG. 7.
Figure 7:
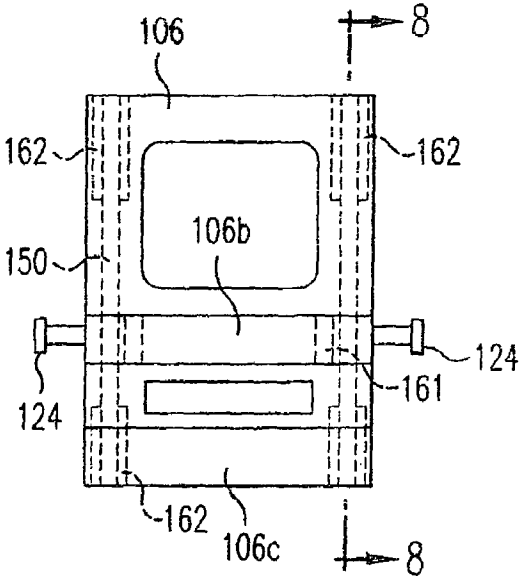
FIG. 7 is a front view of the operating member of FIG. 6.

Referring to FIGS. 7-9, the operating member 106 is formed of synthetic plastic material and includes a body portion 106*a*, a pair of forwardly directed vertically spaced horizontal projections 106*b* and 106*c*, and a pair of rearwardly extending horizontally spaced projecting portions 106*d* that contain openings for receiving cam pins 124, respectively. The forward projection 106*b* contains a pair of vertical through bores 161 for receiving the screw then fastener means that secure the attachment to the nailing gun G.

According to a characterizing feature of the present invention, the operating member 106 is formed of a durable synthetic plastic material, for example, 6691 synthetic plastic nylon and glass composite material. The material is generally a 66% nylon/33% glass composition. Arranged in the through bores 150 contained in the operating member 106 are a plurality of oil-impregnated tubular bushings 162 formed from a suitable material, such as brass.

Figures 10, 11, 12, 13, 14:
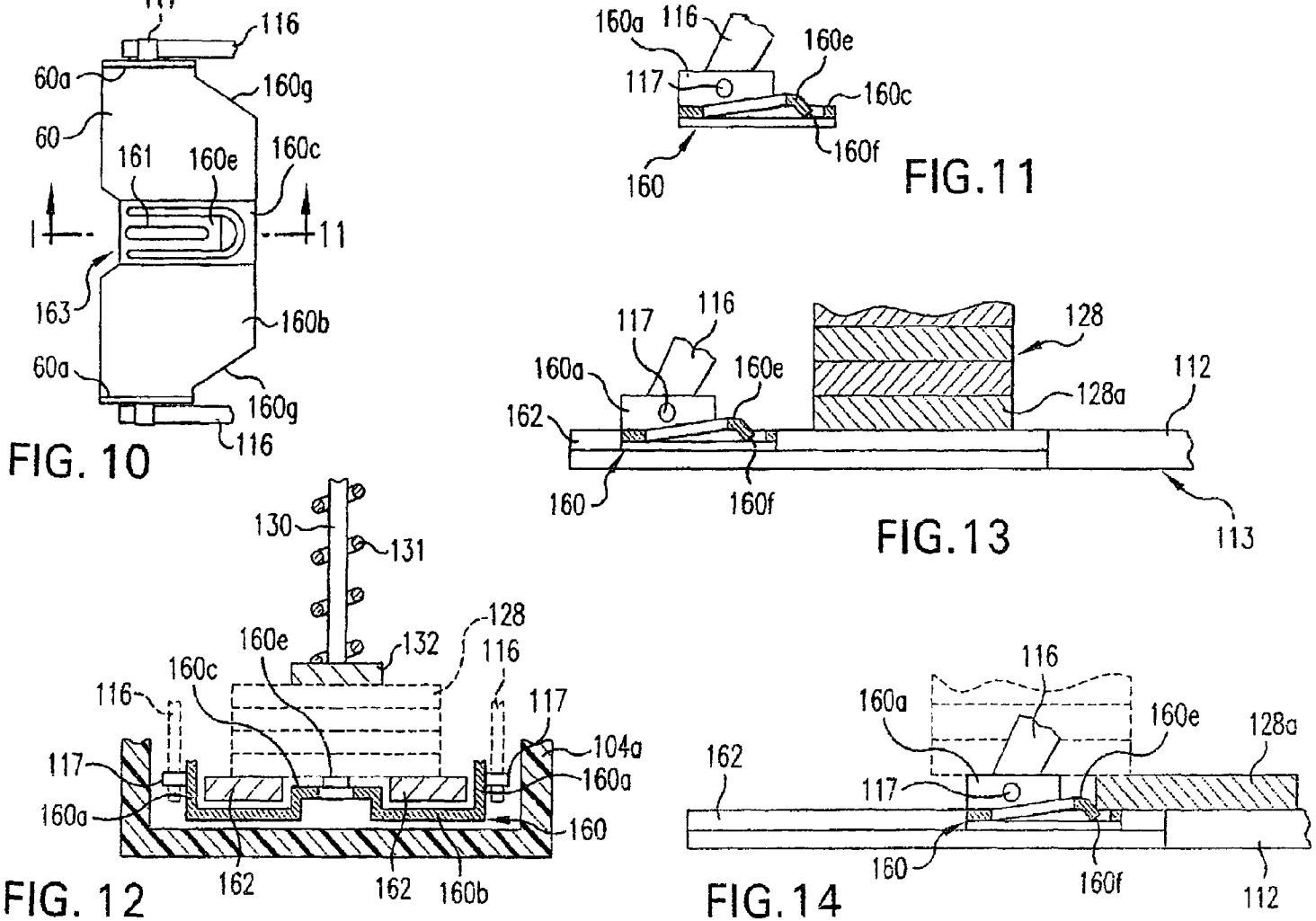
FIG. 10 is a top plan view of the shuttle plate.
FIG. 11 is a sectional view taken along line 11-11 of FIG. 10.
FIG. 12 is a detailed transverse view of the supply station of FIG. 4.
FIGS. 13 and 14 are schematic views illustrating the displacement of the lowermost tin tag from a stack thereof toward the nailing station.

Referring now to FIGS. 10 and 11, the improved shuttle means of the present invention includes a shuttle plate 160 that is formed from a sheet of tempered spring steel. The shuttle plate includes a pair of integral upwardly bent longitudinally extending side wall portions 160*a* that are pivotally connected by rivets 117 with the lower ends of the levers 116 of the linkage means that connects the operating member 106 with the shuttle plate 160. The upper pins of the levers 116 are pivotally connected by pivot pins 118 with the cap portion 104*d* of the housing 104. The shuttle plate 160 is generally planar and has a generally hat-shaped transverse cross section with a central planar offset portion 160*c* that is elevated relative to the main body portion 160*b* of the shuttle plate. This elevated portion 160*c* contains a punched-out tongue portion 160*e* that is angularly bent upwardly at an acute angle relative to the elevated portion 160*c* as shown in FIG. 11, which tongue portion extends longitudinally in the direction from the supply station toward the nailing station. For flexibility, the tongue portion contains a longitudinal slot 161. The free extremity of the tongue portion terminates in a downwardly bent end extremity 160*f*. At one end, the side edges of the shuttle plate contain angularly arranged portions 160*g*, and at the other end the shuttle plate contains a centrally located guide recess 163.

As best shown in FIG. 12, the elevated portion 160*c* of the shuttle plate extends between a pair of longitudinally-extending parallel horizontal support rails 162 that are connected with the housing base portion 104*a*, which is formed from a suitable hard synthetic plastic material, thereby to avoid roofing tar build-up. These horizontal support rails 162 support the tin tag stack 128 that is biased downwardly by the pressure plate 132 and the compression spring 131. Referring to FIGS. 13 and 14, it will be seen that as the shuttle plate 160 is displaced by the levers 116 from the loading position of FIG. 13 toward the nailing station 112, the lowermost tin tag 128*a* is shifted to the right by the angularly bent upwardly extending tongue portion 160*e*.

Operation

In operation, assume that the nailing gun G has been fastened to the operating member 106 by bolts or the like that extend through openings 161 contained in the forwardly projecting horizontal portion 106*b* of the operating member 106. Assume also that the operating member 106 is in its normal upper retracted position shown in FIGS. 4 and 6, whereby the lateral pins 124 on the operating member cooperate with the corresponding cam slot 122 to displace the levers 116 in the counter clockwise direction as shown in FIG. 4, thereby to cause the shuttle plate 160 to be in the delivering position adjacent the nailing station 113. At this time, a tin tag will be supported by tag support means 112 at the nailing station 113 on the base portion 140*a* of the housing 104. When the roofer presses the nailing gun G downwardly toward the tag support means 112, the levers 116 of the actuating linkage are pivoted in the clockwise direction about the pivot pin 118 owing to the action of the cam pins 124 in the corresponding cam slots 122. Therefore, the shuttle plate 160 is displaced to the left toward the loading position shown in FIG. 13, with the tongue portion 160*e* extending upwardly above the upper surface of the support rails 162. Upon release of the tool from the work, the operating member is biased upwardly toward the retracted position by the springs 114, and the next tin tag is displace by the levers 116 and the shuttle plate 120 toward the nailing station 113. The guide slot 163 lines up the shuttle plate to move forward in a parallel orientation, and the angular side edge portions 160*g* serve to sweep dirt away from the channels. The front extremity 160*f* of the tongue is bent down so that it slides under the stack of tags when moving forward. The shuttle plate side walls 160*a* and the offset portion 160*c* keep the shuttle plate properly oriented. The height of the tongue portion 160*e* is 0.0010 inch relative to the customary tin tag thickness of 0014 inch.

While in accordance with the provisions of the Patent Statutes the preferred forms and embodiments of the invention have been illustrated and described, it will be apparent to those skilled in the art that changes may be made without deviating from the invention described above.

What is claimed is:

1. A nailing gun attachment for supplying successive tin tags to a nailing station adjacent an associated nailing gun, comprising:

(a) housing means including a horizontal base portion containing a vertical opening defining a nailing station, said base including a supply station spaced horizontally from said nailing station, said housing including a vertical hollow body portion extending upwardly from said base portion;

(b) cartridge support means connected with said housing body portion for supporting a cartridge containing a vertical stack of tin tags above said supply station;

(c) shuttle means connected with said base portion for movement between a loading position adjacent said supply station and a discharge position adjacent said nailing station, said shuttle means being operable to displace the lowermost tin tag from said stack toward said nailing station; and (d) operating means for displacing said shuttle means between said loading position and said discharging position, said actuating means including:

(1) an operating member adapted for connection with the nailing gun;

(2) guide means guiding said operating member for vertical sliding displacement relative to said housing between an upper retracted position remote from said housing base portion, and a lower nailing position adjacent said base, said guide means including:

(a) a pair of vertical laterally-spaced guide rods formed of metal, said guiding rods slidably extending through a pair of vertical through bores contained in said operating member;

(b) first fastening means fastening the lower ends of said guide rods to said housing base portion; and (c) second fastening means fastening the upper ends of said guide rods to said housing body portion;

(3) linkage means connecting said operating member with said shuttle means to case said shuttle means to be in said loading position and said discharging position when said operating member is in said lower and upper positions, respectively; and (4) spring means biasing said operating member toward said upper position.

2. A nailing gun attachment as defined in claim 1, wherein said operating member is formed from a synthetic plastic material; and further including tubular oil-impregnated bushing means mounted in said through bores concentrically about said guide rods, respectively.

3. A nailing gun attachment as defined in claim 2, wherein said synthetic plastic material comprises a 6691 nylon/glass material; and further wherein said bushings are formed from oil-impregnated brass material.

4. A nailing gun attachment as defined in claim 1, wherein said spring means comprises compression spring means mounted concentrically about said guide rods between said base portion and said operating member.

5. A nailing gun attachment as defined in claim 1, wherein said housing body portion includes a cylindrical hollow body section and an upper cap section; and further wherein said second fastening means comprises a horizontal support plate that is mounted between said housing body and cap sections, said support plate having a marginal portion that extends outwardly from said housing body portion and contains openings receiving the upper ends of said guide rods.

6. A nailing gun attachment as defined in claim 5, wherein said linkage means comprises:

(a) a pair of vertical parallel spaced levers arranged on opposite sides of said housing body portion, said levers having upper ends pivotally connected with said housing cap portion, said levers having lower ends pivotally connected with opposite sides of said shuttle means; and (b) cam means connecting said operating member with intermediate portions of said levers, said cam means including a pair of cam pins extending respectively outwardly from opposite sides of said operating member into corresponding cam slots contained in intermediate portions of said levers.

7. A nailing gun attachment as defined in claim 1, wherein said housing base portion comprises:

(1) an upper surface containing a chamber in which are mounted a pair of horizontal parallel spaced support rails extending longitudinally between said supply station and said nailing station;

(2) said support rails being arranged to support the stack of tin tags at said supply station;

and further wherein said shuttle means comprises:

(1) a horizontal generally planar shuttle plate formed from resilient tempered steel, said shuttle plate being arranged in said chamber beneath said support rails for longitudinal displacement relative to said housing base portion;

(2) said support plate including an integral punched-out tongue portion that extends longitudinally in the direction from said supply station to said nailing station, said tongue portion being bent angularly upwardly for engagement with the lowermost tin tag of the stack and for displacing the same toward said nailing station.

8. A nailing gun attachment as defined in claim 7, wherein said shuttle plate has a generally hat-shaped transverse cross-sectional configuration including a central vertically-offset planar portion that extends longitudinally within the space defined between said support rails, said planar offset portion containing said punched-out tongue portion.

9. A nailing gun attachment as defined in claim 8, wherein said shuttle plate includes a pair of integral upwardly-bent longitudinally-extending vertical side wall portions, said linkage levers being pivotally connected at their lower ends with said shuttle plate side wall portions, respectively.

* * * * *